US007661246B2

(12) United States Patent
Bamberger et al.

(10) Patent No.: US 7,661,246 B2
(45) Date of Patent: Feb. 16, 2010

(54) PACKAGING MACHINE FOR PRODUCING PACKAGING COMPRISING A TRANSPONDER

(75) Inventors: Steffen Bamberger, Dautphetal (DE); Michael Brandt, Bad Laasphe (DE); Klaus Meyer, Breidenbach (DE)

(73) Assignee: CFS Germany GmbH, Biedenkopf-Wallan (DE)

( * ) Notice: Subject to any disclaimer, the term of this patent is extended or adjusted under 35 U.S.C. 154(b) by 0 days.

(21) Appl. No.: 11/911,291

(22) PCT Filed: Apr. 13, 2006

(86) PCT No.: PCT/EP2006/003417

§ 371 (c)(1),
(2), (4) Date: Jun. 17, 2008

(87) PCT Pub. No.: WO2007/022804

PCT Pub. Date: Mar. 1, 2007

(65) Prior Publication Data

US 2009/0090084 A1 Apr. 9, 2009

(30) Foreign Application Priority Data

Apr. 15, 2005 (DE) ..... 10 2005 017 755

(51) Int. Cl.
*B65B 61/00* (2006.01)

(52) U.S. Cl. ..... 53/415; 53/452; 53/473; 53/135.1; 426/383

(58) Field of Classification Search ..... 53/410, 53/415, 452, 473, 128.1, 135.1, 135.2, 135.3, 53/136.1; 340/10.5, 10.51, 572.1; 426/665, 426/383

See application file for complete search history.

(56) References Cited

U.S. PATENT DOCUMENTS

| | | | |
|---|---|---|---|
| 1,709,196 | A | 4/1929 | Snyder |
| 2,331,472 | A | 10/1943 | Holleck |
| 3,054,679 | A | 9/1962 | Bradford |
| 3,561,057 | A | 2/1971 | Butzko |
| 3,661,484 | A | 5/1972 | Psota et al. |

(Continued)

FOREIGN PATENT DOCUMENTS

| | | |
|---|---|---|
| CH | 406036 | 7/1966 |

(Continued)

OTHER PUBLICATIONS

German Search Report, Application No. 102005033194.7, dated Mar. 21, 2006.

(Continued)

*Primary Examiner*—Paul R Durand
(74) *Attorney, Agent, or Firm*—Dobrusin & Thennisch PC

(57) ABSTRACT

The invention relates to a packaging machine for packing food products in a plastic packaging, said machine comprising a device for applying a transponder to the plastic packaging, and a system for data exchange between the transponder and a computer unit and/or a regulating unit, by which means data can be transmitted to the transponder or called therefrom.

20 Claims, 5 Drawing Sheets

U.S. PATENT DOCUMENTS

| | | | | |
|---|---|---|---|---|
| 3,706,174 | A | 12/1972 | Young et al. | |
| 3,760,563 | A | 9/1973 | Zimmerman | |
| 3,792,181 | A | 2/1974 | Mahaffy et al. | |
| 3,815,322 | A | 6/1974 | Wyslotsky | |
| 3,958,394 | A | 5/1976 | Mahaffy et al. | |
| 3,972,155 | A | 8/1976 | Mahaffy et al. | |
| 4,062,718 | A | 12/1977 | Hay, II | |
| 4,932,856 | A | 6/1990 | Merklinghaus et al. | |
| 5,200,007 | A | 4/1993 | Svyatsky | |
| 5,929,760 | A * | 7/1999 | Monahan | 340/572.7 |
| 6,028,518 | A * | 2/2000 | Rankin et al. | 340/572.1 |
| 6,047,579 | A * | 4/2000 | Schmitz | 72/15.1 |
| 6,107,921 | A * | 8/2000 | Eberhardt et al. | 340/572.7 |
| 6,280,544 | B1 * | 8/2001 | Fox et al. | 156/64 |
| 6,543,505 | B1 | 4/2003 | Harte | |
| 7,106,202 | B2 * | 9/2006 | Dickinson | 340/572.8 |
| 7,180,419 | B2 * | 2/2007 | Oakes et al. | 340/572.1 |
| 7,378,965 | B2 * | 5/2008 | Oakes et al. | 340/572.1 |
| 7,383,864 | B2 * | 6/2008 | Hogerton et al. | 156/350 |
| 7,454,880 | B1 * | 11/2008 | Austin et al. | 53/411 |
| 2003/0170357 | A1 * | 9/2003 | Garwood | 426/392 |
| 2003/0182903 | A1 * | 10/2003 | Garwood | 53/478 |
| 2004/0070504 | A1 | 4/2004 | Brollier et al. | |
| 2004/0250960 | A1 | 12/2004 | Harte et al. | |
| 2005/0022470 | A1 * | 2/2005 | Focke et al. | 53/415 |
| 2007/0012708 | A1 | 1/2007 | Send et al. | |
| 2007/0138192 | A1 | 6/2007 | Send et al. | |
| 2009/0056281 | A1 * | 3/2009 | Murray | 53/455 |

FOREIGN PATENT DOCUMENTS

| | | | |
|---|---|---|---|
| DE | 1145087 | | 3/1963 |
| DE | 1159199 | A | 12/1963 |
| DE | 1232873 | | 1/1967 |
| DE | 1461797 | A1 | 2/1969 |
| DE | 2052551 | | 7/1972 |
| DE | 7245361 | | 3/1973 |
| DE | 7414928 | U | 10/1974 |
| DE | 2647556 | A1 | 4/1978 |
| DE | 2843166 | | 4/1980 |
| DE | 3706114 | | 8/1987 |
| DE | 3925746 | A1 | 2/1991 |
| DE | 9110229 | | 12/1992 |
| DE | 4124343 | | 1/1993 |
| DE | 4214530 | A1 | 10/1993 |
| DE | 29619325 | U1 | 1/1997 |
| DE | 19545191 | A1 | 6/1997 |
| DE | 19838289 | | 3/2000 |
| DE | 19911709 | | 9/2000 |
| DE | 19926359 | | 12/2000 |
| DE | 19932458 | A1 | 1/2001 |
| DE | 19950532 | | 7/2001 |
| DE | 10031356 | A1 | 1/2002 |
| DE | 10196098 | T5 | 4/2003 |
| DE | 10228243 | A1 | 1/2004 |
| DE | 20309826 | U1 | 11/2004 |
| DE | 102004005959 | A1 | 9/2005 |
| EP | 040831 | A | 12/1981 |
| EP | 0186729 | | 7/1985 |
| EP | 0367603 | | 5/1990 |
| EP | 0385565 | | 9/1990 |
| EP | 0489797 | B1 | 6/1992 |
| EP | 0791538 | A1 | 8/1997 |
| EP | 0831029 | A1 | 3/1998 |
| EP | 0899209 | A2 | 3/1999 |
| EP | 0949147 | A1 | 10/1999 |
| EP | 1457301 | | 2/2004 |
| EP | 1491317 | | 5/2004 |
| EP | 1493683 | A2 | 1/2005 |
| FI | 112347 | B | 11/2003 |
| FI | 115122 | B | 9/2004 |
| FR | 2606364 | A1 | 11/1986 |
| FR | 2807394 | A1 | 10/2001 |
| JP | 62-039442 | A | 2/1987 |
| JP | 03-275429 | A | 12/1991 |
| JP | 05-221436 | A | 8/1993 |
| JP | 08-040429 | A | 2/1996 |
| JP | 09-142428 | A | 6/1997 |
| JP | 2001-106214 | A | 4/2001 |
| WO | 03/025833 | | 3/2003 |
| WO | 2004/000650 | | 12/2003 |
| WO | 2004/029844 | | 4/2004 |
| WO | 2005/042349 | A | 5/2005 |
| WO | 2005/075291 | A | 8/2005 |
| WO | 2006/092288 | | 9/2006 |
| WO | 2006/092289 | | 9/2006 |
| WO | 2007/022804 | | 3/2007 |
| WO | 2007/090654 | A1 | 8/2007 |
| WO | 2008/034624 | A1 | 3/2008 |

OTHER PUBLICATIONS

International Search Report PCT/WO2006/092289 Aug. 9, 2006.
International Search Report PCT/WO2006/092288 Aug. 8, 2006.
International Preliminary Report on Patentability, Dated Mar. 21, 2007, Application No. PCT/EP2006/001869.
German Search Report, Application No. DE102005007868.1, dated Oct. 14, 2005.
International Preliminary Report on Patentability, Dated May 30, 2007, Application No. PCT/EP2006/001868.
German Search Report, Application No. DE102005009870.3, dated Nov. 23, 2005.
International Search Report PCT/WO2007/022804 Mar. 1, 2007.
International Preliminary Report on Patentability, Dated Jun. 25, 2007, Application No. PCT/EP2006/003417.
German Search Report, Application No. DE102005017755.7, dated Nov. 30, 2005.
International Search Report PCT/WO2007/006551 Jan. 18, 2007.
International Preliminary Report on Patentability, Dated Nov. 9, 2007, Application No. PCT/EP2006/006778.
International Search Report, PCT/EP2007/001092, published Aug. 16, 2007, published as WO2007/090654.
Preliminary Report on Patentability, Dated May 9, 2008, Serial No. PCT/EP2007/001092.
German Search Report, Application No. 102006020361.5, dated Jan. 10, 2007.
Copending U.S. Appl. No. 11/817,196, filed Aug. 27, 2007.
Copending U.S. Appl. No. 11/817,202, filed Aug. 27, 2007.
Copending U.S. Appl. No. 11/181,037, filed Jul. 13, 2005, published as 2007/0012708.
Copending U.S. Appl. No. 11/609,637, filed Dec. 12, 2006, published as 2007/0138192.
Copending U.S. Appl. No. 12/278,681, filed Aug. 7, 2009.
Copending U.S. Appl. No. 12/440,056, filed Mar. 10, 2009, published as WO2008/034624.
Copending U.S. Appl. No. 12/441,596, filed Mar. 17, 2009, published as WO2008/046616.
Copending U.S. Appl. No. 12/442,448, filed Mar. 23, 2009, published as WO2008/046526.

* cited by examiner

PACKAGING MACHINE FOR PRODUCING PACKAGING COMPRISING A TRANSPONDER

CLAIM OF BENEFIT OF FILING DATE

The present application claims the benefit of the filing date of PCT Application Serial No. PCT/EP2006/003417 (filed Apr. 13, 2006) (Published as WO 2007/022804) and DE 10 2005 017 755.7 (filed Apr. 15, 2005), the contents of which are hereby incorporated by reference in their entirety.

The present invention relates to a packaging machine for packaging food products in a plastics material packaging, which has a device for applying a transponder to the plastics material packaging and a means for data exchange between the transponder and a computer and/or control unit, with which data can be transmitted to the transponder and/or optionally retrieved therefrom. Furthermore, the present invention relates to a packaging line having the packaging machine according to the invention as well as a packaging with a transponder.

Nowadays, food products are offered for sale in packagings, in many cases, to increase their durability. The food products are packaged here on what are known as packaging machines, in which a packaging is often shaped, filled with a packaging product, for example the food products and then sealed. Product safety is becoming more and more important here, so the food product producers consider it important that the food packaging has, directly or indirectly, information about the content thereof, the starting products and/or the production process. Information of this type may be stored, for example, on transponders which are part of the food packaging. In particular, the transponder has a numeric electronic product code (EPC), or is inscribed with an EPC, behind which, for example stored on a computer, any desired amount of information is concealed. If the EPC is input into the computer, the information can be retrieved.

It was therefore the object of the present invention to provide a packaging machine for producing packagings, with which food packagings can be produced, which have the aforementioned information.

The object is achieved with a packaging machine for packaging food products in a plastics material packaging, which has a device for applying a transponder to the plastics material packaging and a means for data exchange between the transponder and a computer and/or control unit, with which data can be transmitted to the transponder or can optionally be retrieved therefrom.

For the person skilled in the art, it was extremely astonishing and not to be expected that with the packaging machine according to the invention, it is possible to produce packagings, the content, starting products and/or production process of which can be traced back. The packaging machine according to the invention is simple and economical to produce and operate. The transponders are safely and rigidly arranged on the packaging using a labelling machine. The transponders applied to the packaging are not damaged by subsequent working steps. Furthermore, the packaging machine according to the invention corresponds with the current hygiene specifications, i.e. it can be cleaned easily and completely without, for example, units provided thereon being damaged.

A packaging machine in the sense of the invention is any packaging machine with which, for example, food products or medical articles can be packaged. The packaging machines may be what are known as shaping/filling/sealing packaging machines, horizontal or vertical tubular bag machines as well as so-called tray sealers. The packaging machines may operate continuously or discontinuously, i.e. in a clocked manner.

Furthermore, according to the invention, the packaging machine according to the invention has a device for applying a transponder to a plastics material packaging. This transponder is preferably connected in a material-uniting manner to the packaging, in that, for example, it is glued to the packaging or sealed on the packaging. The transponder is preferably applied to the packaging in such a way that, in the event of an attempt to remove it from the packaging, it is destroyed. If the packaging has a deep-drawn packaging cavity, which is sealed with a cover film, the transponder is preferably arranged in the region of the cover film. The transponder is quite particularly preferably part of a label, which is preferably applied to the packagings with what is known as a labelling machine. In another preferred embodiment, the transponder is arranged in the region of the packaging cavity, so it does not disturb the view of the packaged product and is not immediately perceivable by the consumer.

A transponder in the sense of the invention is a component having a microchip and an antenna. An electronic product code (EPC) and as much information as desired, such as, for example, information about the packaged product, its starting materials, production and packaging method can be stored on the microchip by means of EPS or optionally read out. The transponder is connected, via a means for data exchange, for example an antenna, with a computer, which controls a process which automatically stores data on the transponder or optionally reads it out from the transponder. For this purpose, no physical contact has to exist between the computer and the transponder. In the case of what are known as passive transponders, depending on the frequency, the spacing between the data exchange means and the transponder may be up to three meters. The transponder does not require any type of power supply. The transponder may also be used as a means for avoiding theft. The means for data exchange is preferably arranged close to or on the packaging machine according to the invention, quite particularly preferably directly following the application of the transponder to the packaging. The information stored on the transponder is, in particular an EPC and/or preferably data about the content or the production and packaging method of the product located in each case in the packaging. However, it is also sufficient for the transponder to have data clearly identifying the respective packaging so the respective packaging may be associated with a specific batch, for example. With the aid of this data on the transponder, information about the packaged product and its production and packaging method may be traced back, for example in the event of a complaint, to check whether there were problems during the production method or to identify products from the same batch and optionally remove them from the market.

The transponder located on the packaging also preferably has information for a merchandise management system and/or is used to avoid theft in the shops, in which the respective product is offered for sale. Up to delivery to the end customer and optionally beyond this, it is possible at any time to obtain information about the location of the product and this is very helpful, for example, in the event of recall actions.

The transponder is preferably applied before or after the sealing of the packaging and before the data exchange in the packaging machine according to the invention. In the event of application before sealing, the transponder can be inserted prior to sealing into the packaging, for example, preferably together with the product to be packaged. This embodiment of the packaging machine according to the invention has the advantage that only transponders which are rigidly and safely applied to the respective packaging or are located safely in the packaging, are inscribed, so no confusion or misuse can take place. Furthermore, the transponder is not exposed to any high temperatures.

As already mentioned above, the packaging machine according to the invention may be operated continuously and also in a clocked manner. However, it is preferably operated in a clocked manner. In the case of clocked operation, a batch, which consists of a plurality of packagings, is simultaneously produced and filled with the packaging product. Each packaging is preferably provided with a transponder in each case. The transponder is also preferably arranged on the plastics material packaging simultaneously with the respective label. The transponders are preferably at least partially sequentially applied to the plastics material packagings of a batch.

The data exchange with the transponder, i.e. in particular the storing of data in the transponders of a batch, preferably takes place simultaneously. This means that the packagings of a batch at least partially have the same information, for example the same EPC. This embodiment of the present invention has the advantage that only one data exchange means is required and that the data exchange can take place very rapidly. The attachment and inscription of the transponder does not reduce the cycle speed of the packaging machine. The transponders are preferably inscribed in a stationary state.

In another preferred embodiment, the transponders of a batch are not inscribed with identical information, but each packaging has an individual inscription. This embodiment of the present invention is used, in particular in the case of packaging products with a very high safety standard. In this case, the transponders are preferably inscribed sequentially.

A further subject of the present invention is a packaging line, which has the packaging machine according to the invention and at least one further unit.

A unit in the sense of the invention is any machine, which is arranged upstream or downstream from the packaging machine. Mentioned here by way of example are, only in the area of food processing, food production machines, deep drawing machines, conveyor belts or cartoning machines. In a preferred embodiment, the unit is a cutting machine, with which bars of food, for example sausage bars, cheese bars or ham are cut into slices. A unit of this type is arranged upstream from the packaging machine. The food slices cut by the cutting machine are preferably configured into portions, which are transported by means of a conveyor belt in the direction of the packaging machine according to the invention and placed there into the respective packagings.

The packaging line preferably has a computer. Using this computer, on the one hand, the packaging line is controlled and, on the other hand, data is also processed on the computer, however, which can be transmitted to the transponder or can be read out by the transponder. For example, the information stored on a food bar in the form of a transponder or a bar code is stored in the computer before the food bar is inserted into the cutting machine. This information can then be stored on the transponder of the food packaging, which is filled with the cut slices, so it is possible to clearly allocate which batch has been filled with which food bar. However, the data may also be allocated in the computer to a specific EPC number, which is allocated to a batch with a plurality of packagings or a single packaging. If there are subsequent problems with a packaging, in the two variants, information about the packaging and the batch thereof can be obtained and the entire batch may optionally easily be separated out. A query about a specific EPC may take place via the internet or intranet. Thus, the EPC is read out from the chip on the packaging, for example, with a reading apparatus and communicated to a computer of the producer. Using the EPC, preferably automatically, data about the packaging content and/or production relevant data is communicated back.

The cutting machine can preferably also only be put into operation when information about the input product of the packaging line has been received in the computer.

A further subject of the present invention is a packaging with a reclosing means, in which the reclosing means has a transponder.

The packaging according to the invention has the advantage that two functions can be fulfilled with one means. On the one hand, the packaging may be sealed again and, on the other hand, a clear identification of the product or its production and packaging method is possible. The closure means is preferably a film, with which the packaging can be sealed again along a tear line.

The invention will be described below with reference to FIGS. 1 to 5. These explanations are merely by way of example and do not limit the general idea of the invention. The explanations apply equally to all the subjects of the invention of the present application. In the drawings.

Figure 3:
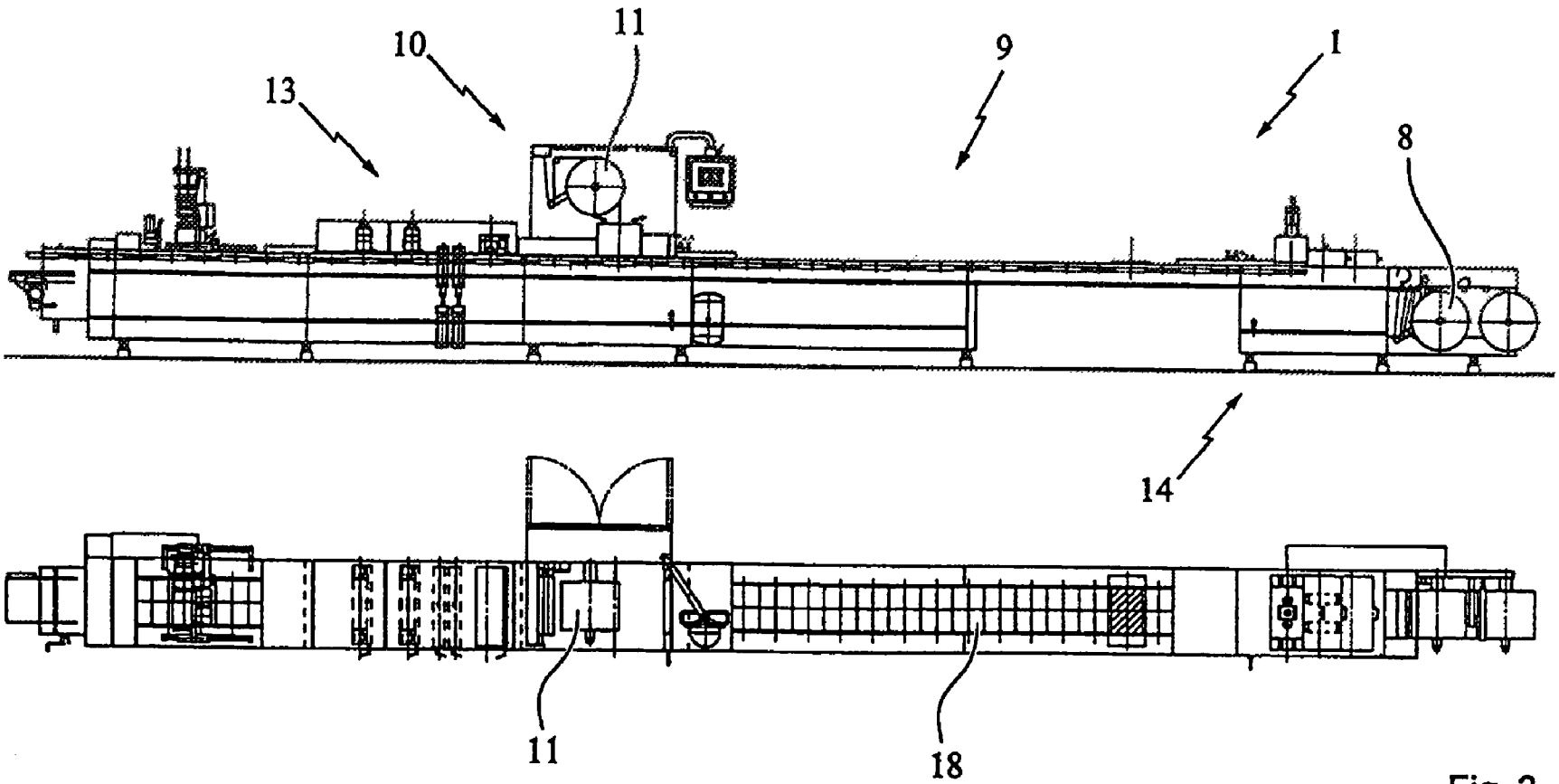

FIG. 3 schematically shows the packaging machine according to the invention.

Figure 4:
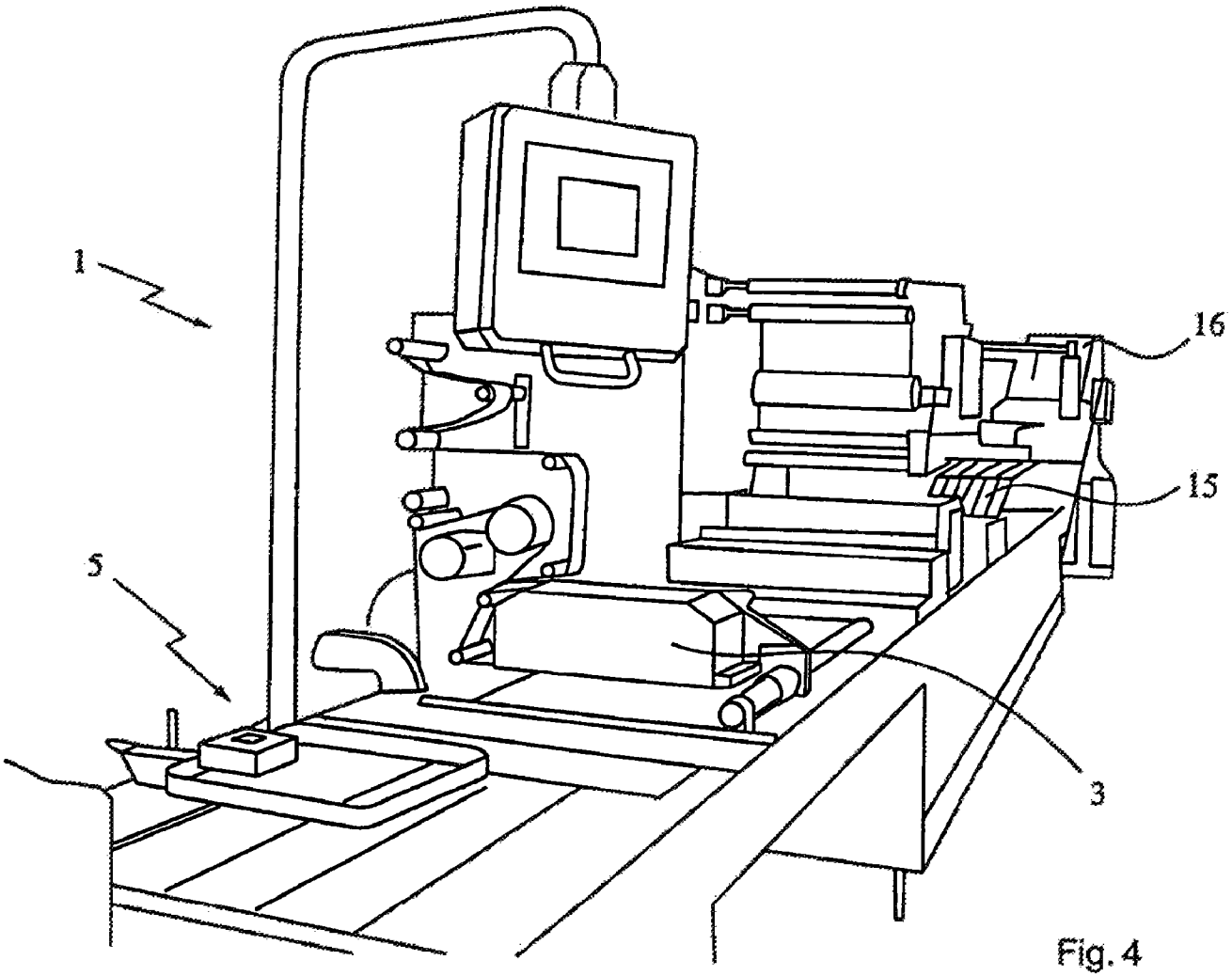

FIG. 4 shows a packaging line with a packaging machine according to FIG. 3.

Figure 5:
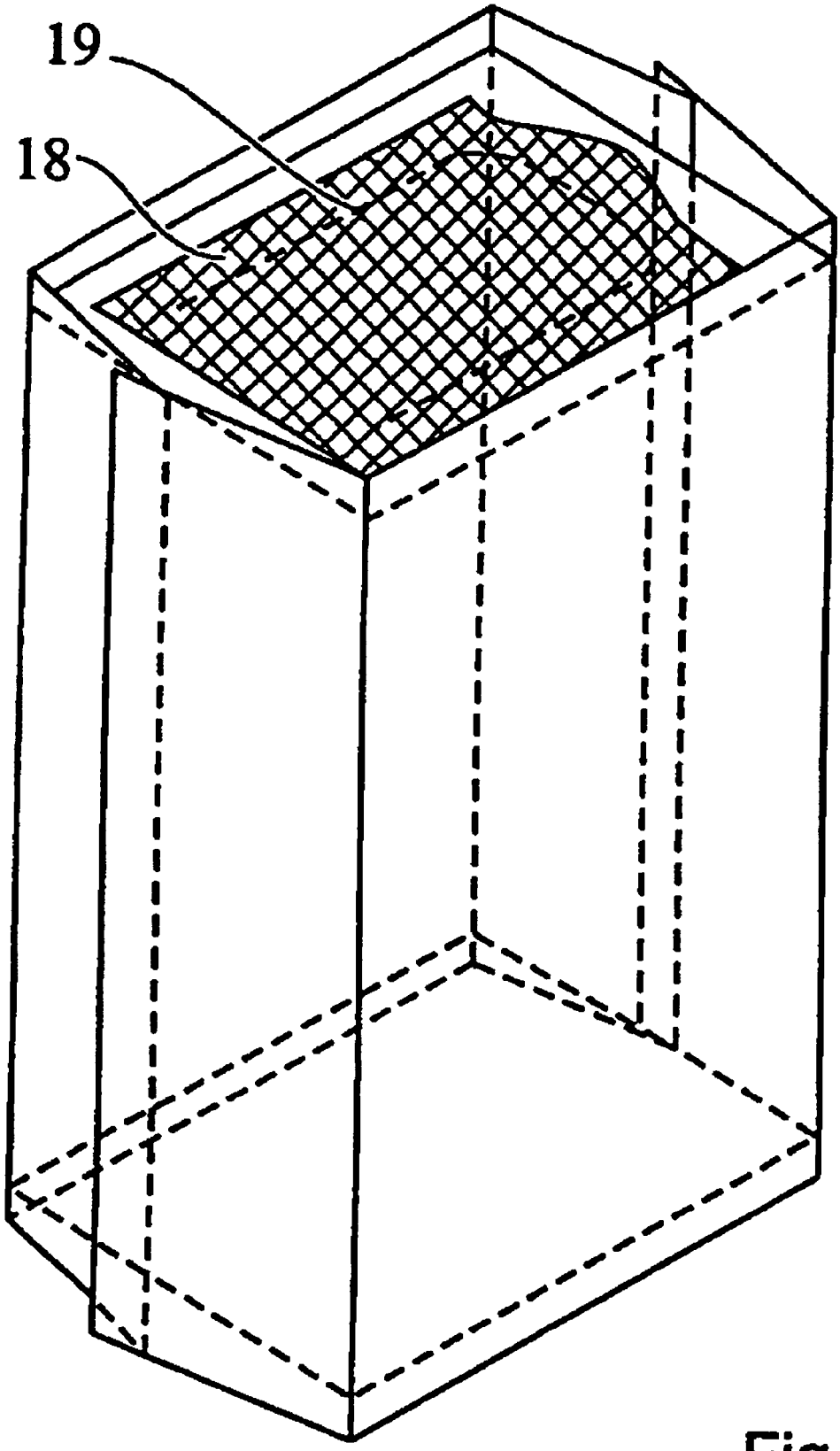

FIG. 5 shows an embodiment of the packaging according to the invention.

Figure 1:
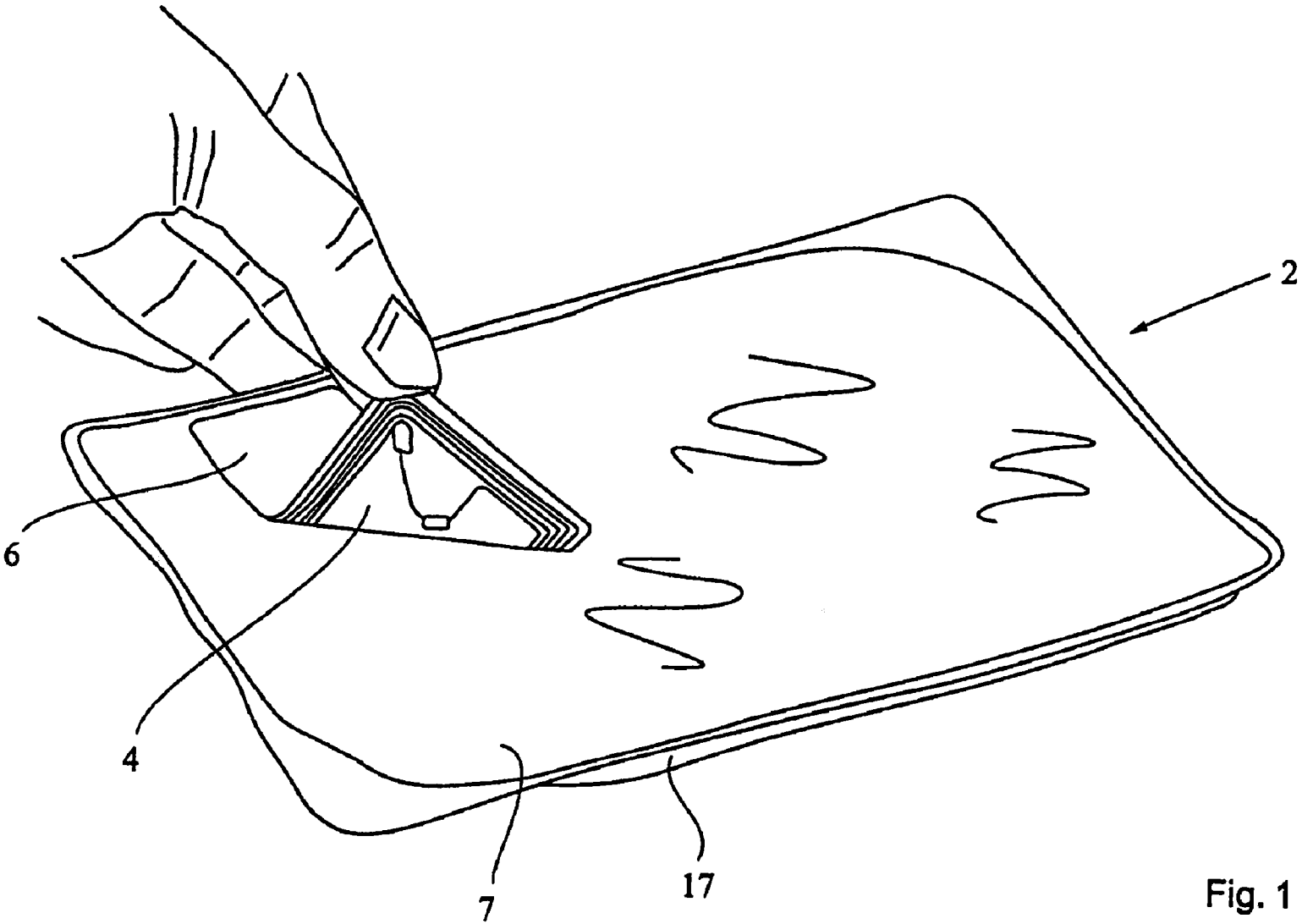
FIG. 1 shows a packaging with a transponder.

FIG. 1 shows a packaging 2 with a transponder 4. The packaging consists of a deep-drawn packaging cavity 17, in which the products to be packaged are placed and which is sealed with a cover film 7, which is sealed to the packaging cavity. The label 6 is glued to this cover film, the transponder 4, which consists of a microchip and an antenna being located on the lower side of this label.

Figure 2:
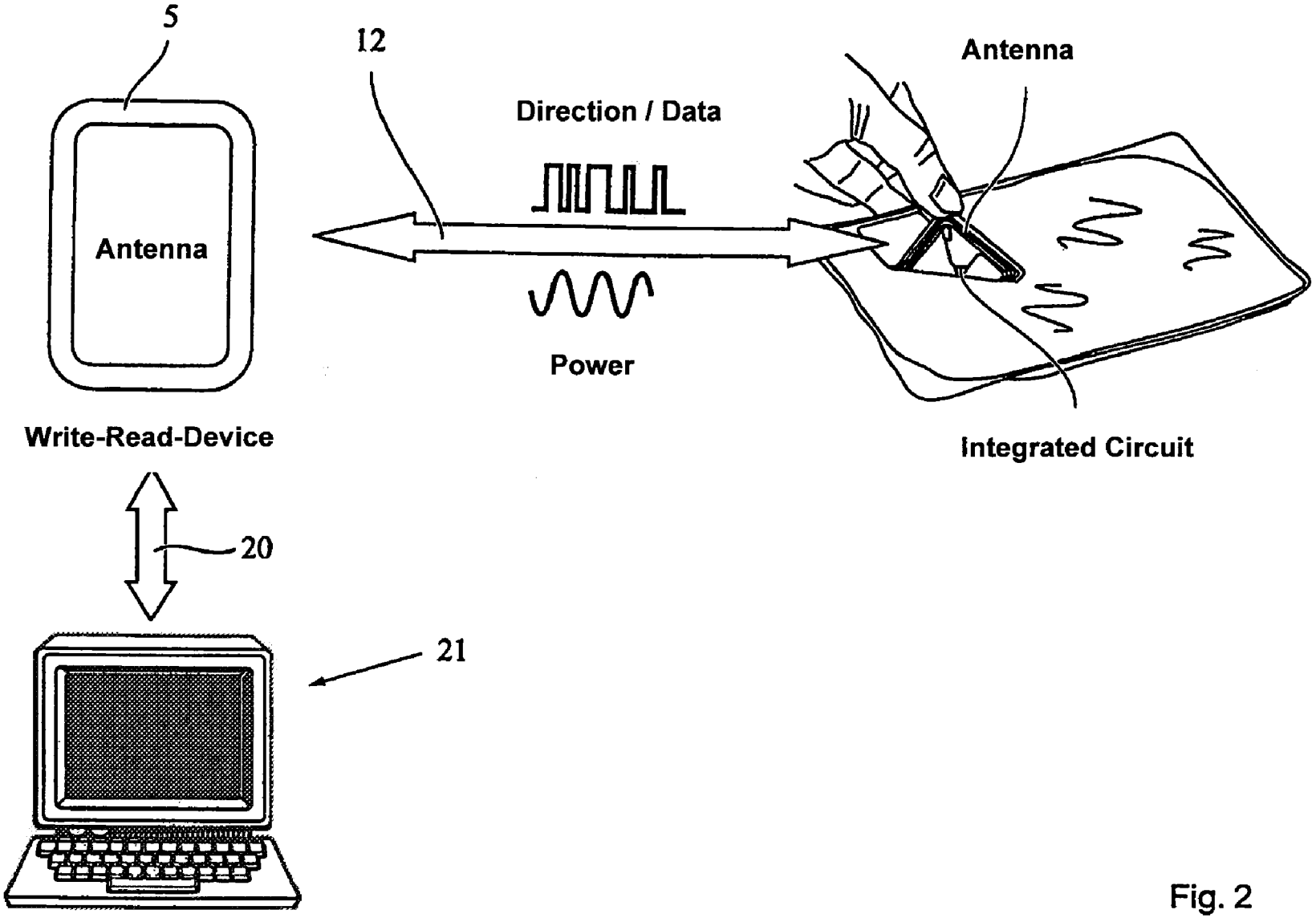
FIG. 2 shows the data exchange between the transponder and the computer arranged on the packaging machine.

The packaging according to FIG. 1 is shown at the top right in FIG. 2. FIG. 2 also shows a means for data exchange 5, an antenna in the present case, with which, as made clear by the double arrow 12, power, control commands and data can be exchanged between the computer of the packaging machine and the transponder. The antenna 5, as shown by the double arrow 20, is in turn connected to a computer 21, with which, on the one hand, the control command for data transmission to the transponder or optionally the control command for reading data out from the transponder and storage thereof in the computer can be transmitted. The person skilled in the art recognises that the computer can also be used to control the packaging device or the packaging line according to the invention described later and to trace the path of the respective product within the packaging line, so it is reliably established which product is located in which packaging. This function is important, in particular in packaging lines, in which the products are sometimes intermediately stored. Furthermore, the person skilled in the art recognises that the computer may also be a network or part of a network.

FIG. 3 shows an embodiment of the packaging machine 1 according to the invention. In the deep-drawing station T4, packaging cavities are deep drawn into the film web 8 in a flat film web rolled on the roll 8. These film webs are filled in the filling station 9 with the product to be packaged, for example with food products or medical articles and then sealed, in the sealing station, with the cover film rolled on the roll 11. In a labelling station 13 arranged downstream, labels and/or transponders are glued onto the finished packagings and a data exchange is carried out with the transponders. The packaging machine according to the invention operates in a clocked manner, a plurality of packaging cavities being produced, filled and sealed per cycle and the data exchange being carried out simultaneously with a plurality of transponders. After the data exchange, the packagings are only separated and generally packaged in relatively large containers, for example boxes.

FIG. 4 shows a packaging line, which consists of the packaging machine 1 according to the invention, a cutting device (slicer) 16 and a conveyor belt 15. Food bars are cut into food slices with the slicer 16 and are configured into portions and placed in the ready-made packaging cavities by means of the conveyor belt 15. Before a food bar can be placed in the slicer, product information, for example a bar code, which is located on the food bar and allows a clear product identification, is read in and stored in the computer 21. The completed packagings are provided with a transponder and optionally a label by means of a labelling machine. With the antenna 5 arranged downstream, during the next cycle, all the transponders of a batch are inscribed with data, in particular data, which provides information about the food bar, the slices of which are located in the respective packaging. The inscription of the transponder is controlled with the same computer which controls the entire packaging line, in particular the interplay between the slicer, conveyor belt and packaging machine. The packagings are subsequently separated and packaged in a box.

FIG. 5 shows an embodiment of a packaging according to the invention, in the present case a packaging, which has been produced on a vertical tubular bag machine. At its upper side, the packaging has a perforated line 19, which can be opened and sealed again by means of a pressure sensitive adhesive label 18. According to the invention, a transponder is arranged on the lower side of this glued-on film. The person skilled in the art recognises that the packaging according to the invention is not limited to the embodiment shown. In particular, the form of the antenna may be adapted to the form of the adhesive.

LIST OF REFERENCE NUMERALS

1 packaging machine
2 plastics material packaging
3 device for applying a transponder, labelling machine
4 transponder
5 means for data exchange, antenna
6 label
7 cover film
8 film roll
9 insertion station
10 sealing station
11 roll with cover film
12 double arrow
13 inscription, data exchange station
14 deep-drawing station
15 conveyor belt
16 cutting device, slicer
17 packaging cavity
18 reclosing means, self adhesive film
19 perforation line
20 double arrow
21 computer

The invention claimed is:

1. A method of packaging, comprising:

a) cutting food products into slices;

b) packaging food products in a plastics material packaging;

c) applying a transponder to the plastics material packaging;

d) exchanging data between the transponder and a computer unit, a control unit, or both; and e) transmitting data to the transponder or retrieving data from the transponder;

wherein the method further includes:

i. cutting the packaging, ii. storing data about an input food product, and iii. processing data before insertion of:

a. the input food product and data about the input product, b. data about the respective processing steps, or c. both is stored on the transponder.

2. A packaging line, comprising:

a) a packaging machine that packages food products in a sealed plastic material packaging;

b) a cutting machine for cutting food products, which is arranged upstream from the packaging machine;

c) a conveyor belt connecting the cutting machine and the packaging machine together so that cut food products are transported from the cutting machine to the packaging machine; and d) a labeling machine located downstream from the cutting machine;

wherein the labeling machine applies a transponder, which includes a microchip and an antenna, to the plastic material packaging of each package so that data is exchanged between the transponder and a computer unit, a control unit, or both wherein data can be transmitted to the transponder or can be retrieved from the transponder;

wherein the packaging machine includes:

i. a CPU, ii. data about an input product, and iii. data about further processing steps wherein the data is stored in the CPU before insertion of:

i. the input product into the packaging line and data about the input product is stored on the transponder, or ii. data about the respective processing steps is stored on the transponder, or iii. both.

3. The packaging line according to claim 2, wherein the transponder is applied before the data exchange.

4. The packaging line according to claim 2, wherein the cutting machine is only put into operation when data about the input product has been read and stored in the CPU.

5. The packaging line according to claim 4, wherein the computer unit or control unit that exchanges data with the transponder also controls the interplay between the slicer, conveyor belt, and packaging machine.

6. The packaging line according to claim 4, wherein the packaging machine operates in a clocked manner.

7. The packaging line according to claim 6, wherein the data transmitted to the transponders of the batch is individual, in each case.

8. The packaging line according to claim 7, wherein the packaging line is a shaping/filling/sealing packaging machine, a tray sealer, a vertical or a horizontal tubular bag packaging machine.

9. The packaging line according to claim 6, wherein the transponder is part of a label and can be glued together therewith to the plastics material packaging, preferably on a cover film thereof.

10. The packaging line according to claim 9, wherein the transponder cannot be removed from the packaging without being destroyed.

11. The packaging line according to claim 2, wherein a batch with a plurality of plastic material packagings can be produced in a cycle.

12. The packaging line according to claim 11, wherein the transponder is applied at least partially sequentially to the plastic material packaging of the batch.

13. The packaging line according to claim 11, wherein the data exchange with the transponders of the batch takes place simultaneously.

14. The packaging line according to claim 13, wherein the transponder is part of a label and can be glued together therewith to the plastics material packaging, preferably on a cover film thereof.

15. The packaging line according to claim 13, wherein the packaging line is a shaping/filling/sealing packaging machine, a tray sealer, a vertical or a horizontal tubular bag packaging machine.

16. The packaging line according to claim 11, wherein the data transmitted to the transponders of the batch is identical in each case.

17. The packaging line according to claim 11, wherein the data exchange with the transponders of the batch takes place sequentially.

18. The packaging line according to claim 17, wherein the transponder is part of a label and can be glued together therewith to the plastics material packaging, preferably on a cover film thereof.

19. The packaging line according to claim 17, wherein the packaging line is a shaping/filling/sealing packaging machine, a tray sealer, a vertical or a horizontal tubular bag packaging machine.

20. The packaging line according to claim 19, wherein the transponder does not require any type of power supply.

* * * * *